United States Patent [19]

Pankoke

[11] Patent Number: 4,693,177

[45] Date of Patent: Sep. 15, 1987

[54] DEVICE FOR APPLYING SURFACE PRESSURE TO AN ADVANCING WORKPIECE

[75] Inventor: Werner Pankoke, Bielefeld, Fed. Rep. of Germany

[73] Assignee: Firma Theodor Hymmen, Bielefeld, Fed. Rep. of Germany

[21] Appl. No.: 731,481

[22] Filed: May 7, 1985

[30] Foreign Application Priority Data

May 10, 1984 [DE] Fed. Rep. of Germany ..... 3417289

[51] Int. Cl.[4] ..... B30B 5/06

[52] U.S. Cl. ..... 100/154; 100/93 P; 156/555; 156/583.5; 277/22; 277/27; 277/DIG. 7; 425/371

[58] Field of Search ..... 100/151, 152, 153, 154, 100/93 P, 93 RP; 156/555,-583.5; 425/371; 277/34, 34.3, 34.6, 227, 22, 27, 200, DIG. 7

[56] References Cited

U.S. PATENT DOCUMENTS

| | | | |
|---|---|---|---|
| 1,868,147 | 7/1932 | Kruse | 277/34 X |
| 2,832,618 | 4/1958 | Knoll et al. | 277/34 |
| 3,501,868 | 3/1970 | Ganzinotti | 277/34.3 X |
| 3,661,197 | 5/1972 | Peterson | 277/226 X |
| 3,788,651 | 1/1974 | Brown et al. | 277/34 |
| 4,253,391 | 3/1981 | Held | 100/154 |
| 4,420,359 | 12/1983 | Goldsworthy | 100/154 X |
| 4,537,408 | 8/1985 | Pankoke | 277/34 |

FOREIGN PATENT DOCUMENTS 0026396 7/1983 European Pat. Off. .

*Primary Examiner*—Peter Feldman
*Attorney, Agent, or Firm*—Michael J. Striker

[57] ABSTRACT

A device for applying surface pressure to an advancing plate-shaped workpiece comprises two endless pressing belts positioned at two opposite surfaces of the advancing workpiece, and two pressure plates spaced from the respective pressing belts and forming pressure chambers containing pressure medium which presses the working strands of the pressing belts against the opposite surfaces of the advancing workpiece. Each pressure plate has a groove engaging an elongated hollow hose filled with the pressure medium and supported against the working strand of the respective pressing belt and limiting the pressure chamber.

9 Claims, 9 Drawing Figures

DEVICE FOR APPLYING SURFACE PRESSURE TO AN ADVANCING WORKPIECE

BACKGROUND OF THE INVENTION

The present invention relates to a device for applying surface or contact pressure to a moving workpiece, such as wooden plate or the like.

Surface pressure-applying devices of the type under consideration include at least one circular pressing belt which is pressed against the workpiece by means of a pressure medium contained in a pressure chamber and wherein the pressure chamber formed between the working strand of the belt and a substantially rectangular pressure plate is limited by a seal supported against the pressing belt.

One of conventional devices of the foregoing type is disclosed in EP No. 0,026,396. The seals between the pressure plate and the respective pressing belt in this known device are formed by sealing strips in the mounting frame which is engaged in the groove of the pressure plate. The mounting frame must be sealed against the groove wall which lies on the side facing away from the pressure chamber; a special seal must be provided for this purpose. Moreover, sealing strips supported on the working strand of the pressing belt must be secured in the groove of the mounting frame.

SUMMARY OF THE INVENTION

It is an object of the present invention to provide an improved device for applying surface pressure to an advancing workpiece.

It is another object of this invention to provide a device in which holding of the sealing, supported on the working strand of the pressing belt, in the pressure plate would be simplified.

These and other objects of the invention are attained by a device for applying surface pressure to an advancing workpiece, particularly wooden plate or the like, comprising at least one endless pressing belt which is pressed against the workpiece by a pressure medium; at least one substantially rectangular pressure plate; at least one pressure chamber containing the pressure medium; and a sealing supported against the pressing belt and positioned at an edge of said pressure plate, said pressure chamber being limited by a portion of a working strand of said belt, said pressure plate and said sealing; said sealing being a hollow hose extending over a peripheral edge of said pressure plate, said pressure plate being formed with a groove of the shape corresponding to that of said hose and receiving said hose, said groove being open towards said pressing belt, said hose being filled with the pressure medium and being immediately supported against the working strand of said belt.

The hose may be made of elastic material.

By loading the interior of the hose with pressure medium the hose becomes rigidly secured in the groove of the pressure plate in the form-locking and force-locking manner. Due to the inner pressure generated in the hose and owing to elastic deformability of the hose material the portion of the hose facing the working strand of the pressing belt is additionally pressed against said working strand.

The hose may be circular, oval, rectangular, or triangular in cross-section.

The hose may be made of plastics or rubber.

The hose may include a sealing strip projecting outwardly from said groove and supported immediately against the working strand of said belt.

The strip may be made of one piece with the hose.

The sealing strip may be provided with an outer layer facing said working strand. The layer may be of metal or ceramics.

The device may further include an outer rail positioned outwardly of said hose and adjacent thereto and an inner rail positioned within said hose rail, said outer rail having a groove engaging said sealing strip.

The device may also include an additional hose radially spaced from said first mentioned hose and having a smaller diameter, said additional hose being filled with the pressure medium, a space between said additional hose and said first mentioned hose being circular and being filled with a cooling agent.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
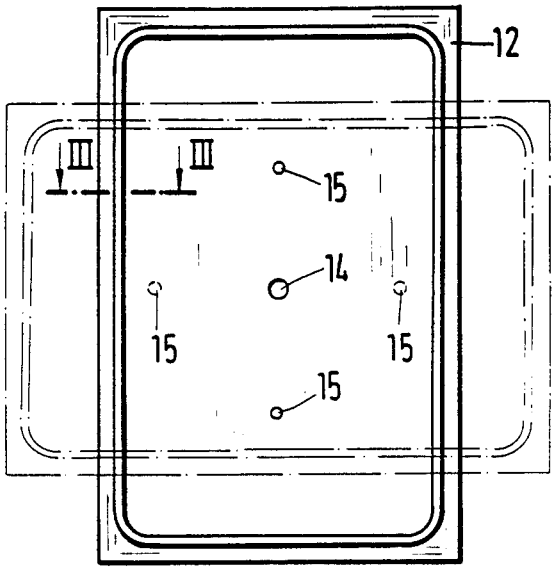
FIG. 1 is a top plan view of the pressure plate rotatable about its central axis and illustrated in two turned positions.
Figure 2:
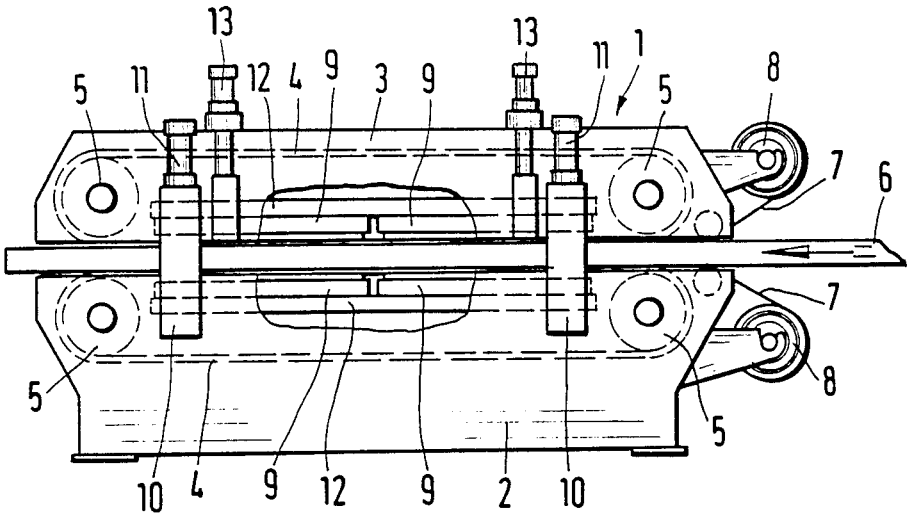
FIG. 2 is a side view of the device of the invention, with the upper and the lower pressing belts.

Referring now to the drawings in detail, and firstly to FIGS. 1 and 2 thereof, the device for applying surface pressure to an advancing workpiece of the invention is designated in toto by reference numeral 1. Device 1 includes a lower frame 2 and an upper frame 3 in which two endless pressing belts 4 are inserted, respectively. The pressing belts 4 are driven by deflection rollers 5. The lower strand of the upper pressing belt 4 is vertically spaced from the upper strand of the lower pressing belt 4 by a gap which corresponds to the width of a workpiece 6 inserted therein. While the pressing belts 4 being in contact with the workpiece 6 move in the horizontal direction the workpiece 6 is pulled into the gap between the outer surfaces of the lower and upper belts and becomes there loaded with pressure exerted by the outer surfaces of the pressing belts. Upon the advancement of the workpiece 6 through the device this workpiece is treated so that the finished workpiece leaves the gap between the pressing belts 4.

In the embodiment shown in FIG. 2 a foil or film 7 is pressed onto the upper and lower faces of the advancing workpiece 6. Film-supplying rotary rollers or reels 8 are provided in the device to advance film 7 towards the workpiece 6. The pressing process can be performed at room temperatures or higher temperatures to which the workpiece is subjected in an operation region. In order to produce a desired pressure the upper frame 3 as a whole can be pressed against the lower frame 2, or, after a rough adjustment of the distance between upper frame 3 and lower frame 2, a required pressure can be exerted by means of pressurized air, the pressure of which is built up in pressure chambers 9 which are provided, respectively, at the back sides of the pressing belts as referred to the workpiece 6. Chambers 9 are also shown in FIGS. 3–6.

In the exemplified embodiment guide carriages 10 are provided for a rough adjustment, these guide carriages being rigidly secured to the lower frame 2 whereas the upper frame 3 is slidably displaceable on these carriages in the direction perpendicular to the advancing movement of workpiece 6. Hydraulic cylinders 11 are provided for such a displacement. The pressure chambers 9, at their sides facing away from the working strands of the pressing belts are each defined by a pressure plate 12, pressure plates 12 being guided over frames 2 and 3, respectively, and their movement is attained by means of hydraulic cylinders 13.

The single pressure plate 12 shown in FIG. 1 is also turnable about its central axis 14 relative to the working strand of the respective pressing belt so that in case of a rectangular shape of the pressure plate the adjustment of the width of the pressure chamber to the various widths of the workpiece can be obtained. Pressure medium can be fed into pressure chambers 9 via openings 15 provided in the pressure plates 12.

Figure 3:
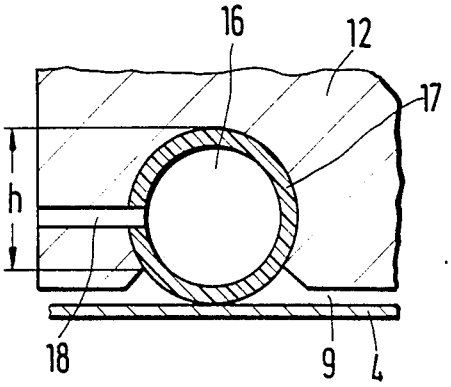
FIG. 3 is a sectional view taken along line III—III of FIG. 1.

Each pressure plate 12 has at its side, facing towards the working strand of the respective pressing belt, a substantially circular recess or groove 16 in which a hose 17 of the round cross-section is positioned as shown in FIG. 3. The limiting contour of recess 16 corresponds to the contour of the round hose. The height h of the recess or groove corresponds approximately to $\frac{2}{3}$ of the outer diameter of the hose 17. The end of the hose extended outwardly from the groove is supported against the pressing belt 4.

A pressure medium, for example pressure air, is fed into the inner space of hose 17 via a passage 18 formed in the plate 12.

Figure 4:
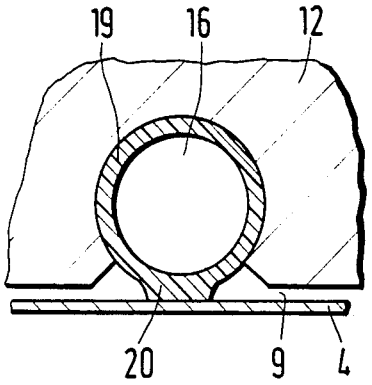
FIGS. 4 through 9 illsutrate sectional views similar to that of FIG. 3 but of various modified embodiments of the invention.
Figure 5:
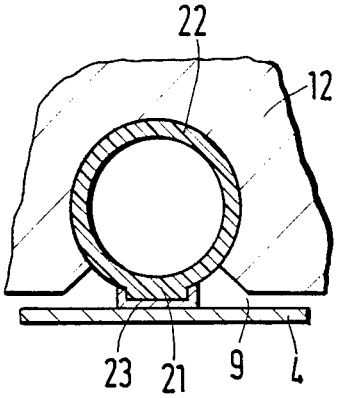

In the modified embodiment illustrated in FIG. 4 hose 19 of a substantially circular cross-section is provided with a sealing projection or strip 20 made of one-piece with the hose. Hose 19 can be formed of plastics or rubber. The sealing strip 20 may differ in its consistency from the remaining material of the hose and can be made of wear-resistant plastics or rubber. In the embodiment of FIG. 4 hose 19 has the sealing strip 20 which is formed of the same material as the remaining portion of the hose whereas in the embodiment of FIG. 5 the sealing strip 21 of hose 22 is provided with an outer sheet-like layer 23 of metal or ceramics. Due to this layer resistance to wear of the sealing strip is substantially enhanced.

Figure 6:
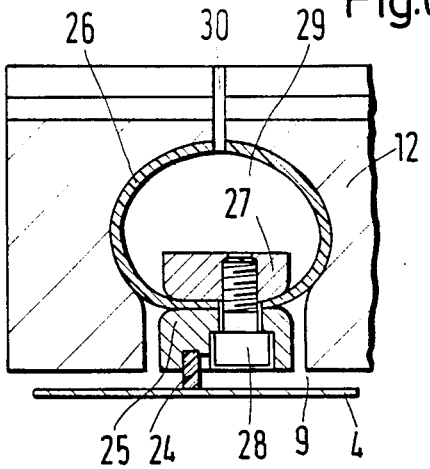

In the embodiment shown in FIG. 6 hose 26 of substantially oval cross-section has a sealing strip 24 which is anchored in a groove formed in an outer profiled rail 25 which is connected to an inner rail 27 positioned in the interior of hose 26. The connection between the outer rail 25 and the inner rail 27 is obtained by bolts 28.

Oval-shaped hose 26 is secured in a groove or recess 29 of the corresponding cross-section, formed in the pressure plate 12. Pressure medium, for example pressure air, is fed into the hose 26 via a passage 30 in the pressure plate 12.

Figure 7:
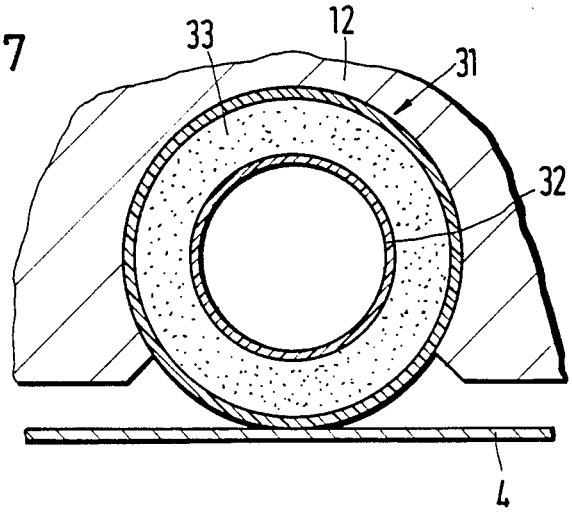

In the embodiment of FIG. 7 two hoses 31 and 32 radially spaced from each other are provided. The internal hose 32 of a smaller diameter is loaded with pressure medium whereas the circular chamber formed between hoses 31 and 32 is filled with a cooling agent. A portion of heat produced during the operation, which is generated in the region of the sealing, is led away by this cooling agent. Thus the service life of the sealing is substantially increased.

Figure 8:
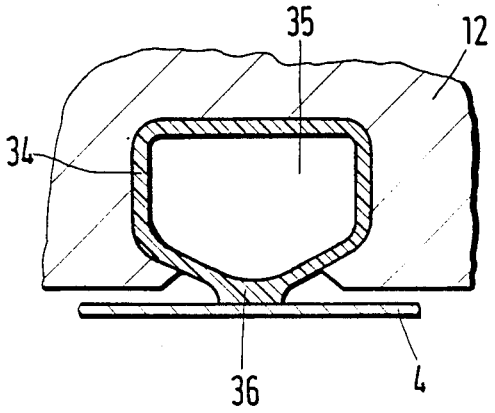

Hose 34 in the embodiment of FIG. 8 has an inner chamber loaded with pressure medium. The hose 34 has a substantially rectangular cross-section and is positioned in a groove 35 of the corresponding cross-section, formed in the pressure plate 12. As seen from FIG. 8 groove 35 is formed so that hose 34 is secured in this groove in a form-locking fashion and only a sealing strip 36 downwardly extended from the hose projects outwardly from the groove. The sealing strip 36 is supported, under the action of the pressure medium contained in the inner space of hose 34, against the working strand of pressing belt 4 in the force-locking fashion.

Figure 9:
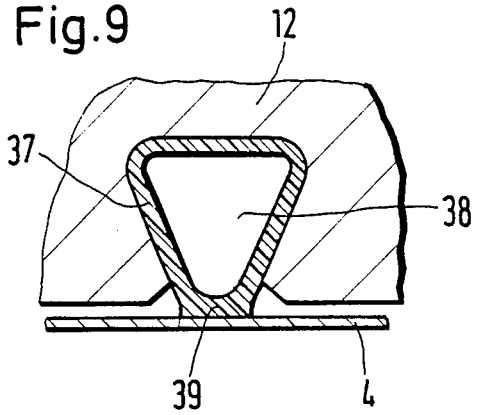

In the embodiment shown in FIG. 9 hose 37 has a triangular cross-section and is positioned in a recess or groove 38 formed in the pressure plate 12. Groove 38 is also triangular and holds hose 37 in the form-locking fashion. Hose 37 has a portion projected outwardly of groove 38. This portion is provided with a sealing strip 39 which abuts against the working strand of pressing belt 4.

It will be understood that each of the elements described above, or two or more together, may also find a useful application in other types of surface-pressure applying devices differing from the types described above.

While the invention has been illustrated and described as embodied in a surface-pressure applying device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a device for applying surface pressure to an advancing workpiece, particularly wooden plates or the like, comprising at least one endless movable pressing belt which is pressed against the workpiece by a pressure medium; at least one substantially rectangular pressure plate; at least one pressure chamber admitted with the pressure medium; and a sealing supported against the pressing belt and positioned at an edge of said pressure plate, said pressure chamber being defined by a portion of a working strand of said belt, said pressure plate and said sealing; the improvement comprising said sealing being a hollow hose of elastic material, said hose extending over a peripheral edge of said pressure plate, said pressure plate being formed with a groove of the shape corresponding to that of said hose and receiving said hose such that the groove overlaps and encloses a major part of said hose and the hose is locked in said groove, said groove being open towards said pressing belt, said hose having an interior loaded with the pressure medium and a smooth contact surface so that it is pressed by said smooth contact surface immediately against the working strand of said movable belt whereby no leakage of the pressure medium occurs in the entire region of said groove, said hose including a sealing strip projecting outwardly from said groove and supported immediately against the working strand of said belt, an outer rail positioned outwardly of said hose and adjacent thereto, and an inner rail, said outer rail having a groove engaging said sealing strip.

2. The device as defined in claim 1, wherein said hose is circular in cross-section.

3. The device as defined in claim 1, wherein said hose is oval in cross-section.

4. The device as defined in claim 1, wherein said hose is rectangular in cross-section.

5. The device as defined in claim 1, wherein said hose is made of plastics.

6. The device as defined in claim 1, wherein said hose is made of rubber.

7. The device as defined in claim 1, wherein said sealing strip is provided with an outer layer facing said working strand.

8. The device as defined in claim 7, wherein said layer is made of metal.

9. The device as defined in claim 7, wherein said layer is made of ceramics.

* * * * *